US005996812A

United States Patent [19]

Sokol, Jr.

[11] Patent Number: 5,996,812

[45] Date of Patent: Dec. 7, 1999

[54] ORGANIZER ASSEMBLY

[75] Inventor: James J. Sokol, Jr., Brea, Calif.

[73] Assignee: Seville Classics, Inc., Los Angeles, Calif.

[21] Appl. No.: 09/062,889

[22] Filed: Apr. 20, 1998

[51] Int. Cl.[6] ..... B42F 17/00; A47F 3/14; A47F 5/14

[52] U.S. Cl. ..... 211/11; 211/126.9; 211/133.2; 211/181.1

[58] Field of Search ..... 211/181.1, 11, 211/126.1–126.9, 133.1, 133.2, 133.3, 133.5, 128.1

[56] References Cited

U.S. PATENT DOCUMENTS

| | | | |
|---|---|---|---|
| 921,694 | 5/1909 | Hall . | |
| 1,712,192 | 5/1929 | Anderson . | |
| 2,192,102 | 2/1940 | Pinto | 211/133.3 |
| 2,398,091 | 4/1946 | Gluckman | 211/133.1 |
| 2,743,020 | 4/1956 | Rubenstein . | |
| 2,916,293 | 12/1959 | Lang | 211/181.1 X |
| 3,181,703 | 5/1965 | Dunham | 211/133.3 |
| 3,225,939 | 12/1965 | Braun | 211/181.1 X |
| 3,395,810 | 8/1968 | Johnson | 211/181.1 X |
| 3,435,958 | 4/1969 | Chesley | 211/133.2 |
| 3,487,951 | 1/1970 | Beltzung | 211/133.2 |
| 3,524,565 | 8/1970 | Wilson | 211/181.1 X |
| 3,704,791 | 12/1972 | Young, Jr. | 211/126.9 |
| 3,927,768 | 12/1975 | Cohen | 211/181.1 X |
| 3,997,060 | 12/1976 | Kunin . | |
| 4,074,810 | 2/1978 | Juergens et al. . | |
| 4,082,190 | 4/1978 | Merz . | |
| 4,099,735 | 7/1978 | Becker, III | 211/133.2 |
| 4,286,718 | 9/1981 | Flax | 211/181.1 |
| 4,369,887 | 1/1983 | Emery | 211/133.1 |
| 4,416,380 | 11/1983 | Flum | 211/181.1 |
| 4,550,838 | 11/1985 | Nathan . | |
| 4,666,201 | 5/1987 | Chap | 211/126.4 |
| 4,744,474 | 5/1988 | Tallving | 211/133.1 |
| 4,771,898 | 9/1988 | Howard et al. | 211/59.2 |
| 4,793,497 | 12/1988 | Hall et al. | 211/133.1 |
| 4,819,899 | 4/1989 | Weil | 211/181.1 X |
| 4,943,029 | 7/1990 | Szuster | 211/181.1 |
| 4,966,278 | 10/1990 | Rosi et al. . | |
| 5,035,335 | 7/1991 | Massoudnia | 211/181.1 X |
| 5,086,936 | 2/1992 | Remmers | 211/126.15 |
| 5,197,614 | 3/1993 | Dalton et al. . | |
| 5,263,595 | 11/1993 | Hilstolsky | 211/133.2 |
| 5,299,698 | 4/1994 | Gay | 211/133.2 |
| 5,379,536 | 1/1995 | Lorenzana . | |
| 5,439,122 | 8/1995 | Ramsay | 211/128.1 |
| 5,613,606 | 3/1997 | Meyer . | |

*Primary Examiner*—David M. Purol
*Assistant Examiner*—Jennifer E. Novosad
*Attorney, Agent, or Firm*—Raymond Sun

[57] ABSTRACT

An organizer assembly has a frame that includes a base that is adapted to rest on a horizontal surface, a rear support extending vertically from the base, and a support ring having a front edge and a rear edge that is attached to the rear support. The assembly further includes a removable tray having a rear edge that is removably engaged with the rear edge of the support ring, and a bottom that is supported by the front edge of the support ring, when the tray is deployed at a horizontal use position with the frame. The removable tray may be deployed by inserting the rear edge of the tray through the support ring at an angle, and then engaging the rear edge of the tray with the rear edge of the support ring.

25 Claims, 5 Drawing Sheets

ORGANIZER ASSEMBLY

BACKGROUND OF THE INVENTION

1. Field of the Invention

The present invention relates to organizer assemblies that are used on a desktop for holding and organizing documents, papers, envelopes, checks and other items. In particular, the present invention relates to an organizer assembly that provides multiple uses, that allows its trays to be removed, and that is simple in construction yet provides a stable support for the trays.

2. Description of the Prior Art

Desktop organizer assemblies are very popular in today's business environment, since they provide a useful means by which people can sort and store documents and other important items. There also exists a wide variety of such desktop assemblies since different people sort and store their documents and materials in a variety of different ways. One type of organizer assembly that has become popular is a multi-tray organizer assembly in which a plurality of trays are stacked one on top of the other in a compact vertical arrangement. Vertically stacked multi-tray organizers provide the user with a plurality of trays for storing different categories of documents, with each of the trays being easily assessible due to the vertical stacked nature of the trays.

Unfortunately, most of these presently-available vertically stacked multi-tray organizer assemblies suffer from a number of drawbacks. For example, some of these assemblies are provided in an integrated structure where the trays are provided in one piece with the frame of the assembly. This reduces the flexibility of the assembly since the user cannot remove or replace any of the trays, and the user cannot add additional trays.

In response to this problem, certain organizer assemblies are provided with a frame or base structure and a plurality of trays that can be removed from the frame. Unfortunately, these organizer assemblies still suffer from at least one or more drawbacks.

First, the structures of some of these organizer assemblies can be rather complex, especially where the frame or base structure is provided with many separate parts that are needed to perform the dual functions of holding the plurality of trays together and allowing these trays to be separated and removed. One such example is illustrated in U.S. Pat. No. 4,074,810 to Juergens et al., in which the riser plate members which support the trays in stacked relation are provided with a relatively complex structure that requires meeting close tolerances for the riser plate members to function effectively.

Second, some of these organizer assemblies are provided in a manner which makes it very inconvenient or difficult to remove the trays. For example, in U.S. Pat. No. 4,550,838 to Nathan et al., the user must remove the top two trays before the bottom tray can be removed. Therefore, the user will be discouraged from removing the lower trays, essentially negating the removability function of the trays. As another example, the structure and/or configuration of the frame of the assembly sometimes obstructs the user's access to the documents in the trays, or makes it inconvenient for the user to remove the tray.

Third, although some of these organizer assemblies may have succeeded in providing a simple structure, the stability of these assemblies may have been compromised.

As a result, there remains a need for an organizer assembly which allows its trays to be conveniently accessed and removed, which is simple in construction, and which is configured to allow the user to conveniently access documents and materials stored therein, yet which provides a stable support for the trays.

SUMMARY OF THE DISCLOSURE

In view of the foregoing, it is an object of the present invention to provide an organizer assembly that allows its trays to be conveniently removed and replaced.

It is a further object of the present invention to provide an organizer assembly which is simple in construction.

It is yet a further object of the present invention to provide an organizer assembly which allows the user to conveniently access the contents stored in the trays and racks.

It is another object of the present invention to provide an organizer assembly that provides stable support for removable trays.

It is yet another object of the present invention to provide an organizer assembly which allows additional organizing mechanisms to be coupled to and used therewith.

In order to accomplish the objects of the present invention, there is provided an organizer assembly having a frame that includes a base that is adapted to rest on a horizontal surface, a rear support extending vertically from the base, and a support ring having a front edge and a rear edge that is attached to the rear support. The assembly further includes a removable tray having a rear edge that is removably engaged with the rear edge of the support ring, and a bottom that is supported by the front edge of the support ring, when the tray is deployed at a horizontal use position with the frame. The removable tray may be deployed by inserting the rear edge of the tray through the support ring at an angle, and then engaging the rear edge of the tray with the rear edge of the support ring.

According to one embodiment of the present invention, the rear edge of the support ring has an inwardly-extending edge portion that removably engages the inside of the rear edge of the tray, and the front edge of the support ring supports the tray at an intermediate portion of the bottom of the tray. The support ring is positioned above the base, and at an angle with respect to the horizontal surface such that the rear edge of the support ring is at a higher vertical level than the lower edge of the support ring.

In accordance with another embodiment of the present invention, the assembly includes a second support ring positioned at a higher vertical level than the other support ring, and adapted to receive and support a second removable tray.

In accordance with yet another embodiment of the present invention, a rack can be removably attached to the frame above the support ring. The rack has a plurality of spaced-apart separators supported by a base wire, the base wire having a leg that is removably attached to the rear support.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

Figure 1:
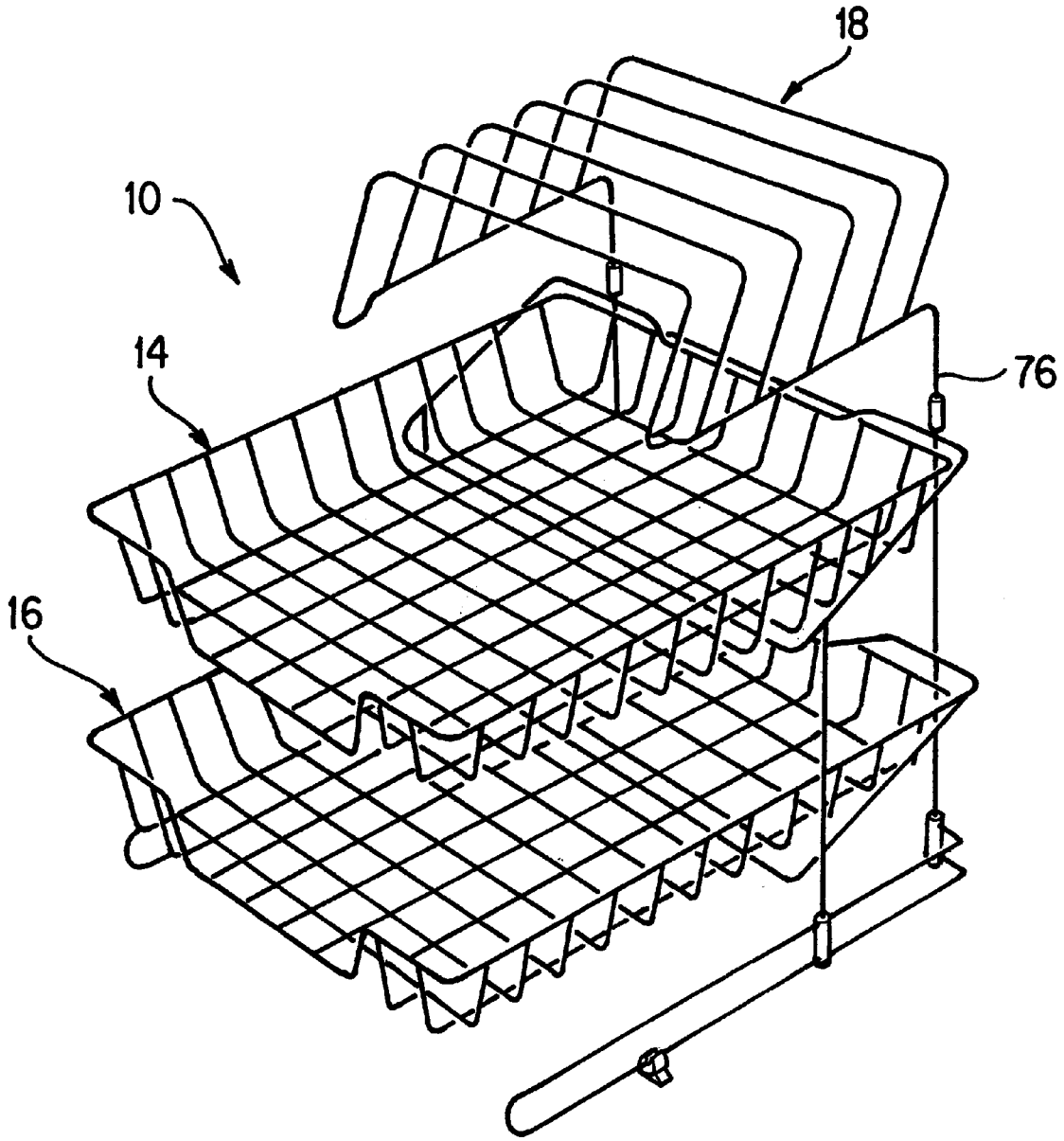
FIG. 1 is a perspective view of the organizer assembly of the present invention.
Figure 2:
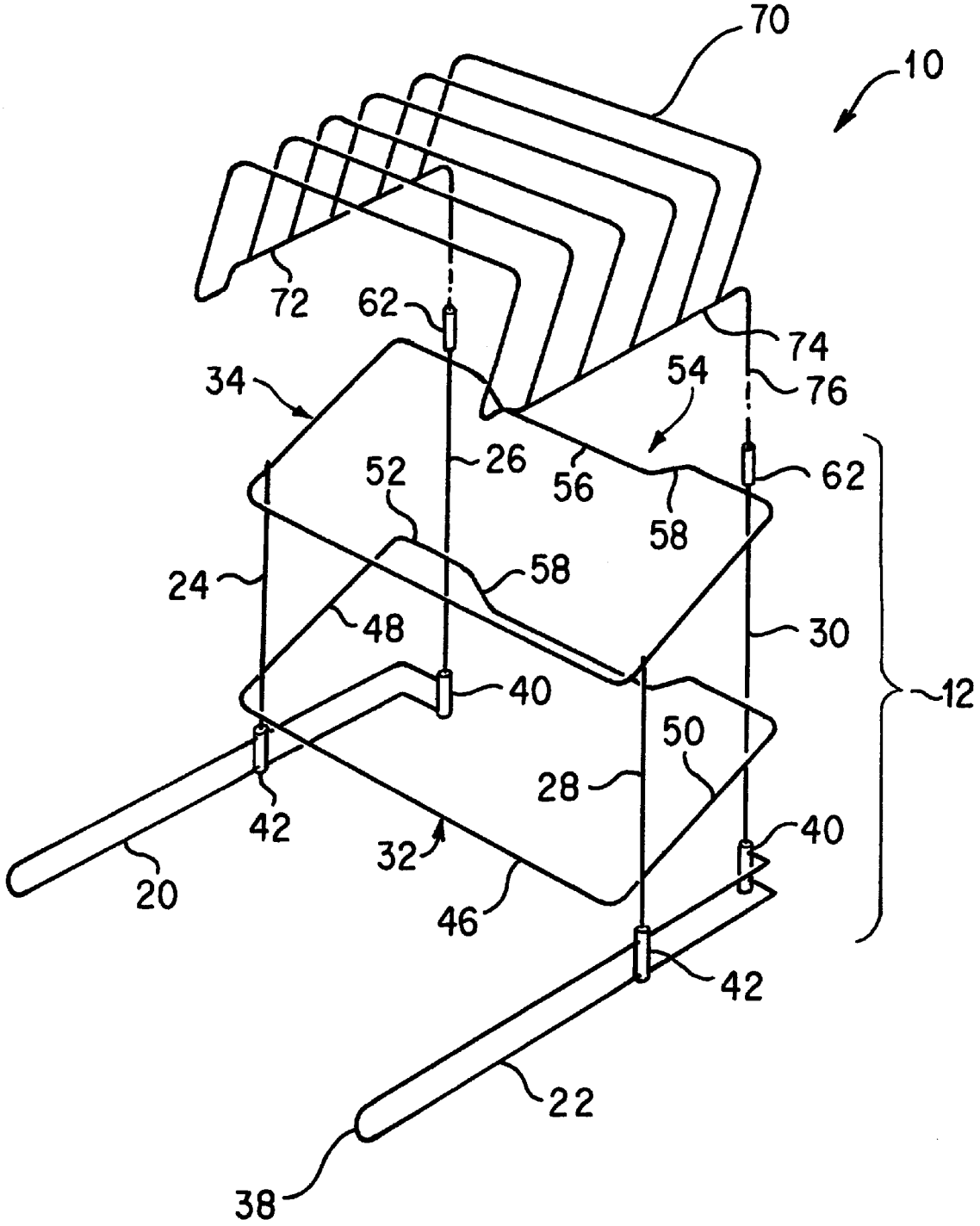
FIG. 2 is an exploded perspective view of the organizer assembly of FIG. 1 illustrating the frame and the rack with both trays removed.
Figure 3:
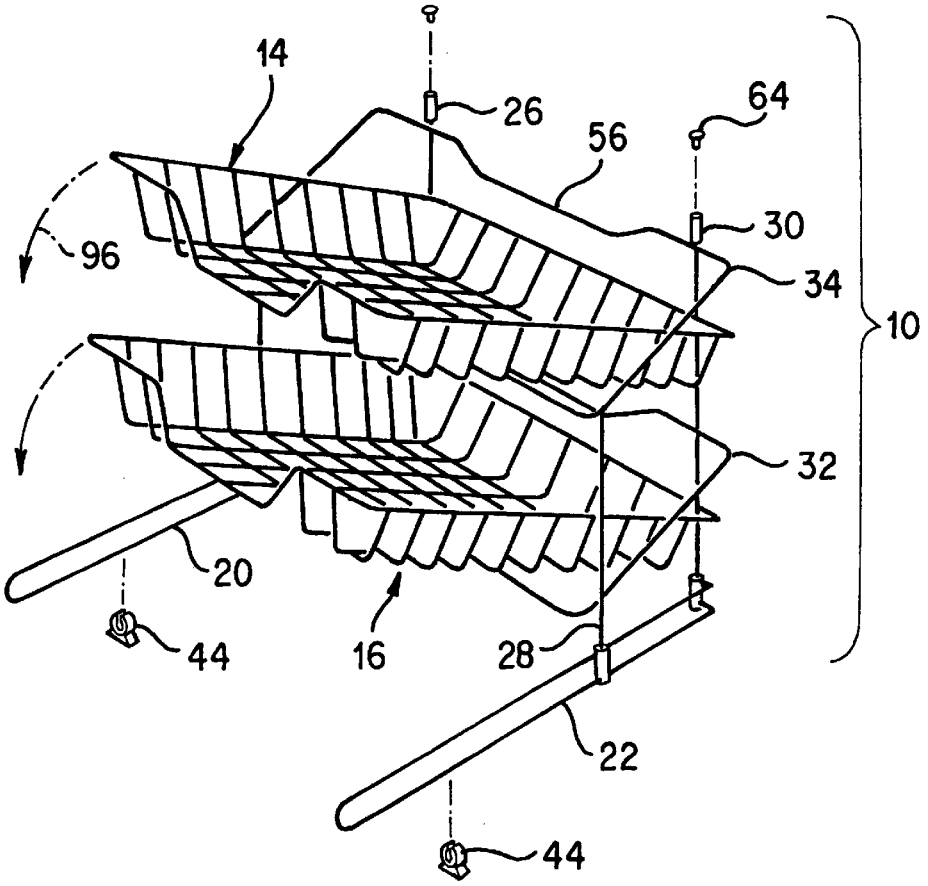
FIG. 3 is a perspective view of the organizer assembly of FIG. 1 illustrating how the trays are inserted into the frame.

One embodiment of an organizer assembly 10 according to the present invention is illustrated in FIGS. 1–6. Referring to FIGS. 1–3, the organizer assembly 10 has a frame 12, an upper tray 14, a lower tray 16, and a tiered rack 18. As shown most clearly in FIG. 2, the frame 12 includes a left base support 20, a right base support 22, a pair of left vertical supports or posts 24 and 26 extending vertically from the left base support 20, a pair of right vertical supports or posts 28 and 30 extending vertically from the right base support 22, and two angled support rings 32 and 34 attached at different vertical levels of the vertical supports 24, 26, 28 and 30. Each of the components of the frame 12 can be made from a material that is sufficiently strong to support heavy contents while providing structural integrity to the assembly 10, and can include a metal wire made of aluminum, steel or brass, among others.

Figure 7:
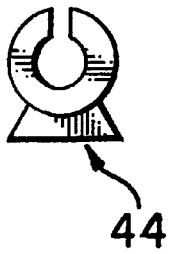
FIG. 7 illustrates a foot pad that can be used with the organizer assembly of FIG. 1.

The left and right base supports 20 and 22 are identical in structure, and each base support 20, 22 has a generally elongated U-shape with one side of the "U" adapted to rest on a surface, and with the curve 38 of the "U" (i.e., the bottom of the "U") extending towards the front of the assembly 10. A rear support cylinder 40 is provided at the rear (i.e., the top of the "U") of each base support 20, 22. In addition, a front support cylinder 42 is provided at a portion between the intermediate portion and rear portion of each base support 20, 22. The support cylinders 40 and 42 can be provided in a manner in which they connect the parallel sides of the "U" of each base support 20, 22. The rear support cylinders 40 are adapted to receive and support the rear vertical supports 26 and 30, and the front support cylinders 42 are adapted to receive and support the front vertical supports 24 and 28. Referring to FIGS. 3 and 7, one foot pad 44 may be clipped to each base support 20, 22 to provide stability and to protect the surface on which the assembly 10 is placed (i.e., the foot pads 44 prevent the base supports 20, 22 from sliding along and scratching the surface).

Figure 4:
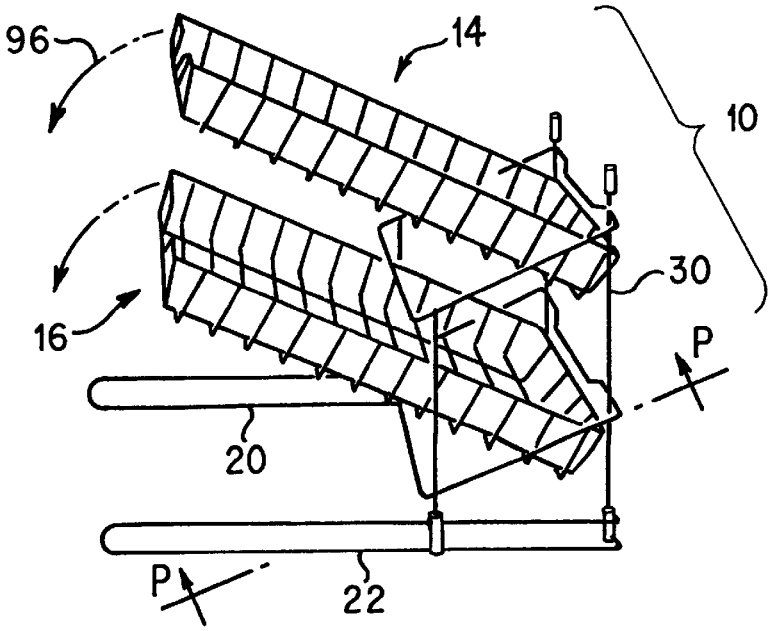
FIG. 4 is a side plan view of the organizer assembly of FIG. 3.
Figure 5:
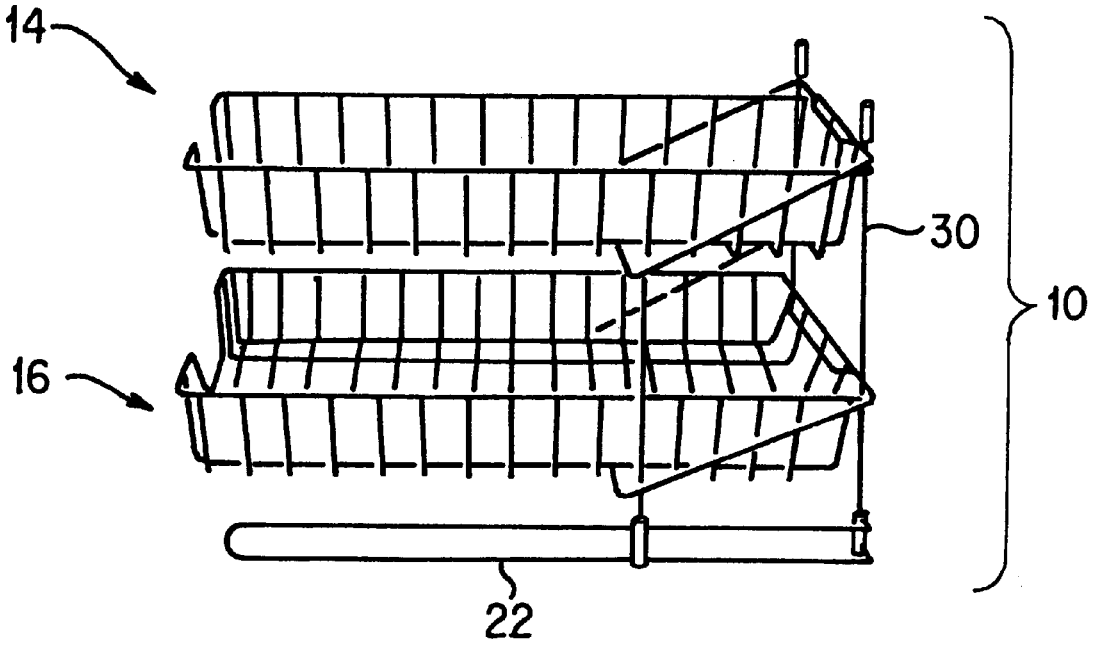
FIG. 5 is a side plan view of the organizer assembly of FIG. 1 illustrating the trays in their normal use position.
Figure 8:
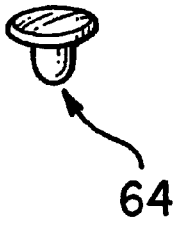
FIG. 8 illustrates a cap that can be used with the organizer assembly of FIG. 1.

The angled support rings 32 and 34 may be attached to the vertical supports 24, 26, 28 and 30 by welding, soldering, screws, glue, or other conventional means. As best shown in FIGS. 4 and 5, the angled support rings 32 and 34 are identical in structure to each other, and are disposed at an angle with respect to the horizontal axis. Referring back to FIG. 2, each support ring 32, 34 has a generally rectangular configuration having a generally straight front edge 46, two parallel and generally straight side edges 48 and 50, and a rear edge 52 parallel to and opposite from the front edge 46. The rear edge 52 is not straight, but has a retaining portion 54 that extends inwardly towards the front edge 46. Specifically, the retaining portion 54 is defined by an inner edge 56 that is generally parallel to the front edge 46 and the rear edge 52, but which is positioned inwardly towards the front edge 46. The inner edge 56 is connected to the rear edge 52 by a pair of connecting edges 58. In addition, all the edges 46, 48, 50, 52, 56 and 58 of each support ring 32, 34 are preferably disposed in the same plane. This is best illustrated in FIG. 4 by the plane P. As best shown in FIGS. 4 and 5, the rear vertical supports 26 and 30 are longer than the front vertical supports 24 and 28. The upper support ring 34 is connected to the top of the front vertical supports 24 and 28, and the rear edge 52 of the upper support ring 34 is connected to the rear vertical supports 26 and 30 at a vertical level that is higher than the vertical level of the connection of the upper support ring 34 to the front vertical supports 24, 28. Similarly, the lower support ring 32 is connected to the rear vertical supports 26 and 30 at a vertical level that is higher than the vertical level of its connection to the front vertical supports 24, 28. This causes the support rings 32 and 34 to be angled with respect to the horizontal surface, as shown in FIGS. 4 and 5. An upper support cylinder 62 is provided at the top of each rear vertical support 26 and 30, and has a bore (not shown) that is adapted to receive a leg of the rack 18, as described below. If a rack 18 is not being used, or has been removed, a cap 64 (see FIGS. 3 and 8) can be inserted into the top of each upper support cylinder 62 to cover the upper support cylinder 62.

Referring to FIG. 2, the rack 18 has a plurality of spaced-apart separators 70, each of which is configured as an inverted "U" shape, and connected at opposite ends to separate base wires 72 and 74. The separators 70 are positioned at an angle with respect to a vertical axis. Each base wire 72, 74 is bent at its rear end to form a leg 76 which is inserted into the bore of one of the upper support cylinders 62 provided at the top of each rear vertical support 26 and 30. Envelopes, letters, checks, folders, and other small or large paper items can be retained between adjacent separators 70. When deployed with the assembly 10, the rack 18 is positioned above the rear portion of the upper tray 14 in a position that will not obstruct the user's access to documents resting inside the upper tray 14. In addition, the materials placed between the separators 70 face the user (i.e., the front of the assembly 10) for convenient reference and access by the user. The rack 18 can be made in one piece, and from the same material as the components of the frame 12.

Figure 6:
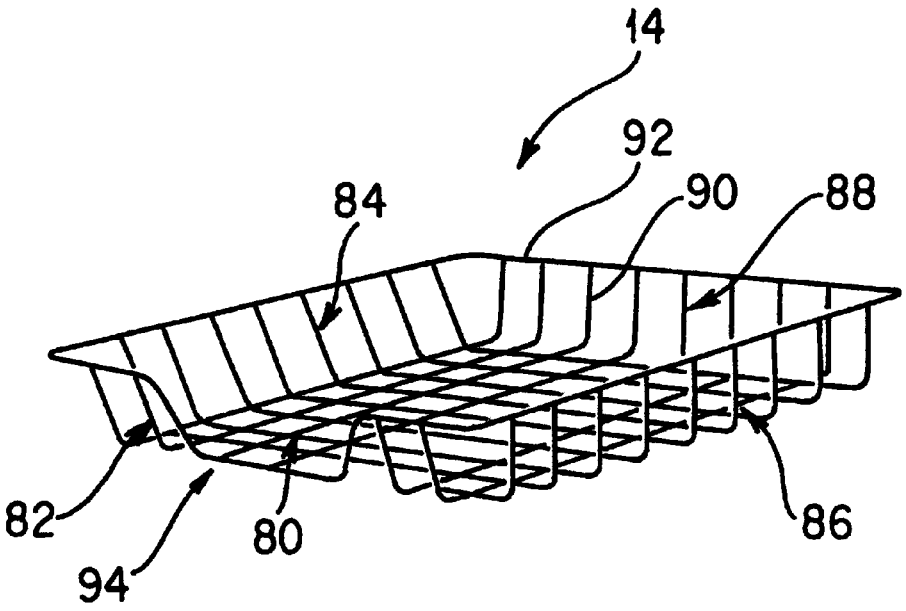
FIG. 6 is a perspective view of one tray of the organizer assembly of FIG. 1.

Referring now to FIG. 6, one tray 14 or 16 is illustrated. All the trays 14, 16 are preferably identical so that the user can remove the trays 14, 16 and replace them with other identical trays. Thus, it is possible for a user to have more than two trays, using these additional trays as stand-alone trays until it is desired to replace one of the upper tray 14 or the lower tray 16 with the stand-alone tray. Each tray 14, 16 has a bottom or base 80 that is surrounded by a front wall 82, two side walls 84, 86, and a rear wall 88. The rear wall 88 is grated with parallel bars 90, and has a top edge 92. The front wall 82 has an opening 94 that provides access to the interior of the tray 14. Although the base 80 and walls 82, 84, 86, 88 are illustrated as being grated with parallel and/or crossing bars, they can also be provided in the form of solid walls made of plastic, metal, or cardboard, among other materials.

The use and operation of the organizer assembly 10 will now be described. Referring first to FIG. 2, the rack 18 may be installed at the top of the frame 12 by inserting the legs 76 of the rack 18 into the cylindrical supports 62. The rack 18 may be installed before or after the trays 14 and/or 16 are deployed. Otherwise, caps 64 may be inserted into the bores of the cylindrical supports 62 to cover the cylindrical supports 62 and to provide smooth top corners.

To deploy, for example, the upper tray 14 in the frame 12, the rear of the tray 14 is inserted through the upper support ring 34 at an angle, as shown in FIGS. 3 and 4. When the rear wall 88 of the tray 14 is adjacent the rear edge 52 of the upper support ring 34 (see FIG. 4), the front of the tray 14 is pivoted downwardly (see arrow 96), which simultaneously pivots the rear of the tray 14 upwardly until the rear top edge 92 of the tray 14 is engaged by the retaining portion 54 of the upper support ring 34. In particular, the rear top edge 92 of the tray 14 engages the inner edge 56 in a manner such that the inner edge 56 is latched or locked on the inside of the rear top edge 92, as shown in FIG. 5. In this deployed or use position, the tray 14 lies substantially parallel to the horizontal surface. In addition, the tray 14 is stably supported within the frame 12 because an intermediate portion of the bottom 80 of the tray 14 rests on the front edge 46 of the upper support ring 34 while the top rear edge 92 is latched to the retaining portion 54 of the upper support ring 34. For example, the front of the tray 14 cannot be pressed or tilted down because the top rear edge 92 is latched to the retaining portion 54 of the upper support ring 34.

The lower tray 16 can also be deployed inside lower support ring 32 in the same manner. The fully deployed organizer assembly 10 is illustrated in FIGS. 1 (with the rack 18) and 5 (without the rack 18). Since the support rings 32 and 34 only extend to a portion of the trays 14, 16 that is between the center and the rear of the trays 14, 16 (see FIG. 5), the frame 12 does not obstruct access to either tray 14, 16, or to the rack 18.

To remove a tray 14 from the frame 12, the front of the tray 14 is pivoted upwardly in a direction opposite from the direction of the arrow 96, which simultaneously pivots the rear of the tray 14 downwardly to disengage the rear top edge 92 of the tray 14 from the retaining portion 54 of the upper support ring 34. The tray 14 can then be lifted or slid out of the upper support ring 34 at the angle illustrated in FIGS. 3 and 4.

Thus, the trays 14, 16 can be conveniently, quickly, and easily deployed inside or removed from the frame 12. The latching interaction between the top rear edge 92 of each tray 14, 16 and the retaining portion 54 provides a simple yet stable engagement mechanism for stably securing the tray 14, 16 to the frame 12. The front edge 46 of each support ring 32, 34 provides further support and stability to the trays 14, 16 and the entire assembly 10. The rack 18 not only provides the assembly 10 with additional utility and usefulness, but can also be conveniently, quickly, and easily deployed with or removed from the frame 12. The rack 12 also allows materials to be stored therein in a manner where the materials can be easily visualized and accessed by the user.

Those skilled in the art will appreciate that the embodiments and alternatives described above are non-limiting examples only, and that certain modifications can be made without departing from the spirit and scope thereof. The accompanying claims are intended to cover such modifications as would fall within the true scope and spirit of the present invention.

As one non-limiting example, although the assembly 10 of the present invention is illustrated as having two support rings 32 and 34 that support two trays 16 and 14, it is possible to provide any number of support rings, each for supporting a tray.

As another non-limiting example, other organizing mechanisms can be provided in lieu of, or in addition to, the rack 18. As long as the size, weight and structure of such a mechanism is not greater than that of a tray 14, this mechanism can be provided with legs that can be inserted into the cylindrical supports 62 and supported at the top of the frame 12.

What is claimed is:

1. An organizer assembly comprising:

a frame having a base that is adapted to rest on a horizontal surface, a rear support extending vertically from the base, and a support ring having a front edge, and a rear edge that is attached to the rear support, with the support ring positioned above the base and at an angle with respect to the horizontal surface such that the rear edge of the support ring is at a higher vertical level than the front edge of the support ring; and a removable tray having a rear edge that is removably engaged with the rear edge of the support ring, and a bottom that is supported by the front edge of the support ring, with the tray being parallel to the horizontal surface when the rear edge of the tray engages the rear edge of the support ring.

2. The assembly of claim 1, wherein the rear edge of the tray removably engages the rear edge of the support ring such that the rear edge of the support ring extends inside the rear edge of the tray.

3. The assembly of claim 1, wherein the tray further includes a front edge, and wherein the front edge of the support ring supports the bottom of the tray at a position that is closer to the rear edge of the tray than the front edge of the tray.

4. The assembly of claim 1, further including a rack removably attached to the frame above the support ring.

5. The assembly of claim 1, wherein the rack has a plurality of spaced-apart separators supported by a base wire, the base wire having a leg that is removably attached to the rear support.

6. The assembly of claim 1, wherein the frame further includes a front vertical support extending vertically from the base and attached to the front edge of the support ring.

7. The assembly of claim 6, wherein the rear vertical support includes a pair of spaced-apart rear vertical posts and the front vertical support includes a pair of spaced-apart front vertical posts, with the rear edge of the support ring attached to the pair of spaced-apart rear vertical posts, and the front edge of the support ring attached to the pair of spaced-apart front vertical posts.

8. The assembly of claim 1, wherein the support ring is a first support ring and the tray is a first tray, the assembly further including:

a second support ring having a front edge and a rear edge that is attached to the rear support, the second support ring positioned at a higher vertical level than the first support ring; and a second removable tray having a rear edge that is removably engaged with the rear edge of the second support ring, and a bottom that is supported by the front edge of the second support ring, with the second tray being parallel to the horizontal surface when the rear edge of the second tray engages the rear edge of the second support ring.

9. An organizer assembly comprising:

a frame having a base that is adapted to rest on a horizontal surface, a rear support extending vertically from the base, and a support ring having a front edge, and a rear edge that is attached to the rear support; and a removable tray having a rear edge that is removably engaged with the rear edge of the support ring such that the rear edge of the support ring extends inside the rear edge of the tray, and the tray having a bottom that is supported by the front edge of the support ring, when the rear edge of the tray engages the rear edge of the support ring.

10. The assembly of claim 9, wherein the support ring is positioned above the base, and at an angle with respect to the horizontal surface such that the rear edge of the support ring is at a higher vertical level than the front edge of the support ring.

11. The assembly of claim 9, wherein the tray further includes a front edge, and wherein the front edge of the support ring supports the bottom of the tray at a position that is closer to the rear edge of the tray than the front edge of the tray.

12. The assembly of claim 9, further including a rack removably attached to the frame above the support ring.

13. The assembly of claim 9, wherein the frame further includes a front vertical support extending vertically from the base and attached to the front edge of the support ring.

14. The assembly of claim 13, wherein the rear vertical support includes a pair of spaced-apart rear vertical posts and the front vertical support includes a pair of spaced-apart front vertical posts, with the rear edge of the support ring attached to the pair of spaced-apart rear vertical posts, and the front edge of the support ring attached to the pair of spaced-apart front vertical posts.

15. The assembly of claim 9, wherein the support ring is a first support ring and the tray is a first tray, the assembly further including:

a second support ring having a front edge and a rear edge that is attached to the rear support, the second support ring positioned at a higher vertical level than the first support ring; and a second removable tray having a rear edge that is removably engaged with the rear edge of the second support ring such that the rear edge of the second support ring extends inside the rear edge of the second tray, and the second tray having a bottom that is supported by the front edge of the second support ring, when the rear edge of the second tray engages the rear edge of the second support ring.

16. An organizer assembly comprising:

a frame having a base that is adapted to rest on a horizontal surface, a rear support extending vertically from the base, and a support ring having a front most edge, and a rear edge disposed in a horizontal plane, with the rear edge attached to the rear support; and a removable tray having a front edge, a rear edge that is removably engaged with the rear edge of the support ring, and a bottom, with the front most edge of the support ring supporting the bottom of the tray at a position that is closer to the rear edge of the tray than the front edge of the tray, when the rear edge of the tray engages the rear edge of the support ring.

17. The assembly of claim 16, wherein the support ring is positioned above the base, and at an angle with respect to the horizontal surface such that the rear edge of the support ring is at a higher vertical level than the front most edge of the support ring.

18. The assembly of claim 16, further including a rack removably attached to the frame above the support ring.

19. The assembly of claim 16, wherein the frame further includes a front vertical support extending vertically from the base and attached to the front edge of the support ring.

20. The assembly of claim 19, wherein the rear vertical support includes a pair of spaced-apart rear vertical posts and the front vertical support includes a pair of spaced-apart front vertical posts, with the rear edge of the support ring attached to the pair of spaced-apart rear vertical posts, and the front edge of the support ring attached to the pair of spaced-apart front vertical posts.

21. The assembly of claim 16, wherein the support ring is a first support ring and the tray is a first tray, further including:

a second support ring having a front edge and a rear edge that is attached to the rear support, the second support ring positioned at a higher vertical level than the first support ring; and a second removable tray having a rear edge that is removably engaged with the rear edge of the second support ring, and a bottom that is supported by the front edge of the second support ring.

22. The assembly of claim 16, wherein the rear edge of the tray removably engages the rear edge of the support ring such that the rear edge of the support ring extends inside the rear edge of the tray.

23. A method of deploying a removable tray in an organizer assembly, the organizer assembly having a frame that includes a base that is adapted to rest on a horizontal surface, a rear support extending vertically from the base, and a support ring having a front edge and a rear edge that is attached to the rear support, comprising the steps of:

a. providing a removable tray having a rear edge and a bottom;

b. inserting the rear edge of the tray through the ring at an angle, with respect to the horizontal, without engaging the support ring; and c. engaging the rear edge of the tray with the rear edge of the support ring such that the rear edge of the support ring extends inside the rear edge of the tray.

24. The method of claim 23, further including the step of:

d. supporting the bottom of the tray on the front edge of the support ring.

25. The method of claim 23, wherein step (c) includes the step of pivoting the tray so that rear edge of the tray is pivoted upwardly to engage the rear edge of the support ring.

* * * * *